US009119512B2

(12) United States Patent
Martins, Jr. et al.

(10) Patent No.: US 9,119,512 B2
(45) Date of Patent: Sep. 1, 2015

(54) VACUUM CLEANER AND VACUUM CLEANING SYSTEM AND METHODS OF USE IN A RAISED FLOOR ENVIRONMENT

(75) Inventors: Manuel E. Martins, Jr., Cranston, RI (US); Marek Sadowski, Gdynia (PL); Tomasz Czarnecki, Kolo (PL); Roman Iwaszko, Terespol (PL); Franciszek Miklaszewicz, Warsaw (PL); Lukasz Kszonowski, Sopot (PL)

(73) Assignee: MARTINS MAINTENANCE, INC., East Providence, RI (US)

( * ) Notice: Subject to any disclaimer, the term of this patent is extended or adjusted under 35 U.S.C. 154(b) by 697 days.

(21) Appl. No.: 13/432,304

(22) Filed: Mar. 28, 2012

(65) Prior Publication Data

US 2012/0260944 A1 Oct. 18, 2012

Related U.S. Application Data

(60) Provisional application No. 61/522,902, filed on Aug. 12, 2011.

(30) Foreign Application Priority Data

Apr. 15, 2011 (PL) ..... 394570

(51) Int. Cl.

| | |
|---|---|
| ***B08B 3/00*** | (2006.01) |
| ***A47L 5/14*** | (2006.01) |
| ***A47L 9/00*** | (2006.01) |
| ***A47L 9/04*** | (2006.01) |
| ***A47L 9/08*** | (2006.01) |

(52) U.S. Cl.

CPC ... *A47L 5/14* (2013.01); *A47L 9/00* (2013.01); *A47L 9/0472* (2013.01); *A47L 9/08* (2013.01); *A47L 2201/00* (2013.01); *A47L 2201/04* (2013.01)

(58) Field of Classification Search

None

See application file for complete search history.

(56) References Cited

U.S. PATENT DOCUMENTS

| | | | |
|---|---|---|---|
| 4,970,753 | A | 11/1990 | Herron, Jr. |
| 5,242,474 | A | 9/1993 | Herbst et al. |

(Continued)

FOREIGN PATENT DOCUMENTS

| | | | |
|---|---|---|---|
| EP | 1269901 | A1 | 1/2003 |
| EP | 1929914 | A2 | 6/2008 |
| EP | 2047782 | A2 | 4/2009 |

OTHER PUBLICATIONS

International Search Report for PCT/US2012/033225 mailed Jul. 13, 2012.

(Continued)

*Primary Examiner* — Eric Golightly

(74) *Attorney, Agent, or Firm* — Lando & Anastasi, LLP

(57) ABSTRACT

A remote-controlled, autonomous, or semi-autonomous vacuum cleaner for raised floor environments is especially configured to clean tight, hard-to-reach areas, such as the space between the floor and the raised panels of a raised access floor system and a control module for remotely operating the vacuum cleaner. The vacuum includes a body, a power source supported by the body, a vacuum module supported by the body, the vacuum module being configured to intake air and exhaust air, and a drive module supported by the body. The body includes an outer casing having channels formed therein, with the channels being configured to divide and channel exhaust flow and to direct exhaust flow in multiple directions.

15 Claims, 10 Drawing Sheets

(56) References Cited

U.S. PATENT DOCUMENTS

| | | | |
|---|---|---|---|
| 6,457,206 | B1 | 10/2002 | Judson |
| 6,463,368 | B1 | 10/2002 | Feiten et al. |
| 6,493,612 | B1 | 12/2002 | Bisset et al. |
| 6,496,754 | B2 | 12/2002 | Song et al. |
| 6,597,143 | B2 | 7/2003 | Song et al. |
| 6,745,431 | B2 | 6/2004 | Dijksman et al. |
| 6,883,201 | B2 | 4/2005 | Jones et al. |
| 6,925,679 | B2 | 8/2005 | Wallach et al. |
| 6,938,298 | B2 | 9/2005 | Aasen |
| 7,059,012 | B2 | 6/2006 | Song et al. |
| 7,113,847 | B2 | 9/2006 | Chmura et al. |
| 7,167,775 | B2 | 1/2007 | Abramson et al. |
| 7,201,786 | B2 | 4/2007 | Wegelin et al. |
| 7,251,853 | B2 | 8/2007 | Park et al. |
| 7,275,280 | B2 | 10/2007 | Haegermarck et al. |
| 7,320,149 | B1 | 1/2008 | Huffman et al. |
| 7,356,873 | B2 | 4/2008 | Nielsen |
| 7,412,748 | B2 | 8/2008 | Lee et al. |
| 7,444,206 | B2 | 10/2008 | Abramson et al. |
| 7,503,096 | B2 | 3/2009 | Lin |
| 7,568,259 | B2 | 8/2009 | Yan |
| 7,571,511 | B2 | 8/2009 | Jones et al. |
| 7,581,282 | B2 | 9/2009 | Woo |
| 7,599,758 | B2 | 10/2009 | Reindle et al. |
| 7,603,744 | B2 | 10/2009 | Reindle |
| 7,749,294 | B2 | 7/2010 | Oh et al. |
| 7,761,954 | B2 | 7/2010 | Ziegler et al. |
| 7,805,220 | B2 | 9/2010 | Taylor et al. |
| 7,861,365 | B2 | 1/2011 | Sun et al. |
| 7,937,800 | B2 | 5/2011 | Yan |
| 2002/0153855 | A1 | 10/2002 | Song et al. |
| 2003/0060928 | A1 | 3/2003 | Abramson et al. |
| 2004/0143930 | A1 | 7/2004 | Haegermarck |
| 2004/0220698 | A1 | 11/2004 | Taylor et al. |
| 2004/0236468 | A1 | 11/2004 | Taylor et al. |
| 2005/0015913 | A1 | 1/2005 | Kim et al. |
| 2005/0022331 | A1 | 2/2005 | Kim et al. |
| 2005/0055792 | A1 | 3/2005 | Kisela et al. |
| 2005/0125937 | A1 | 6/2005 | Nielsen |
| 2005/0166354 | A1 | 8/2005 | Uehigashi |
| 2005/0204505 | A1 | 9/2005 | Kashiwagi |
| 2005/0234611 | A1 | 10/2005 | Uehigashi |
| 2005/0235451 | A1 | 10/2005 | Yan |
| 2005/0251947 | A1 | 11/2005 | Lee et al. |
| 2005/0267631 | A1 | 12/2005 | Lee et al. |
| 2006/0085095 | A1 | 4/2006 | Reindle et al. |
| 2006/0190135 | A1 | 8/2006 | Lee et al. |
| 2006/0195224 | A1 | 8/2006 | Song et al. |
| 2006/0229765 | A1 | 10/2006 | Bommer et al. |
| 2007/0016328 | A1 | 1/2007 | Ziegler et al. |
| 2007/0130717 | A1 | 6/2007 | Yan |
| 2007/0209143 | A1 | 9/2007 | Choi et al. |
| 2008/0184518 | A1 | 8/2008 | Taylor et al. |
| 2008/0276408 | A1 | 11/2008 | Gilbert, Jr. et al. |
| 2008/0282494 | A1 | 11/2008 | Won et al. |
| 2009/0049640 | A1 | 2/2009 | Lee et al. |
| 2009/0126143 | A1 | 5/2009 | Haegermarck |
| 2009/0133720 | A1 | 5/2009 | Van Den Bogert |
| 2009/0260180 | A1 | 10/2009 | Meredith et al. |
| 2009/0271940 | A1 | 11/2009 | Lee |
| 2010/0011529 | A1 | 1/2010 | Won et al. |
| 2010/0050366 | A1 | 3/2010 | Splinter |
| 2010/0107355 | A1 | 5/2010 | Won et al. |
| 2010/0192314 | A1 | 8/2010 | Otsuka et al. |
| 2010/0332067 | A1 | 12/2010 | Abramson |
| 2011/0056759 | A1 | 3/2011 | Chiu et al. |
| 2011/0131741 | A1 | 6/2011 | Jones et al. |

OTHER PUBLICATIONS

Extended European Search Report from corresponding European Application No. 12771516.7 dated Jan. 23, 2015.

FIG. 6A
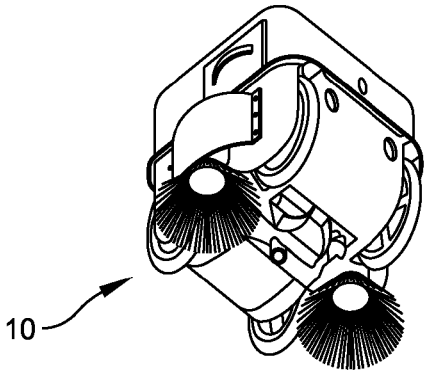
FIG. 6B
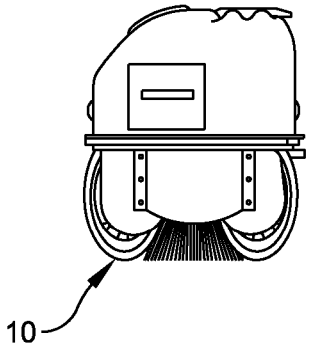
FIG. 6C
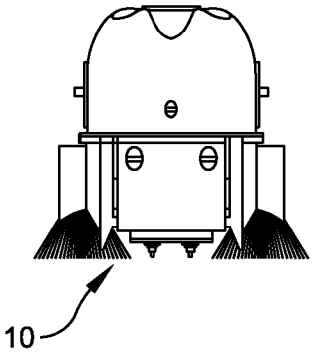
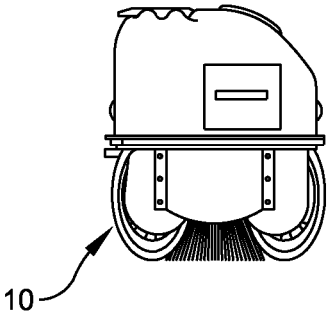
FIG. 6D
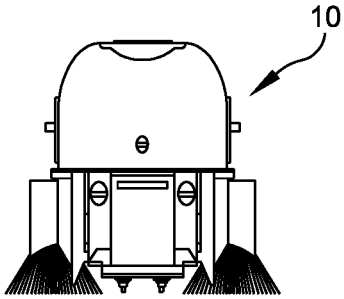
FIG. 6E
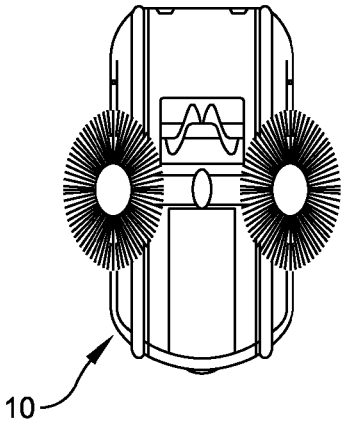
FIG. 6F
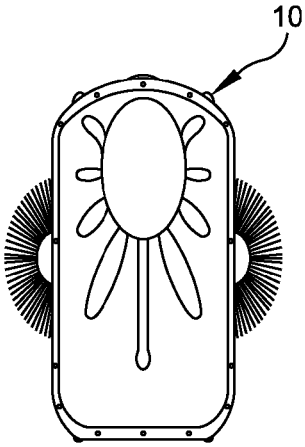
FIG. 6G
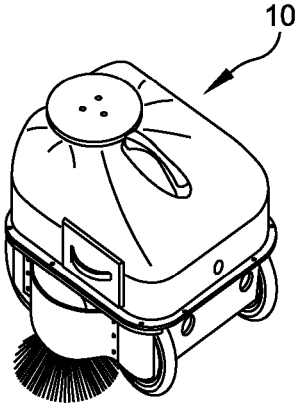
FIG. 6H

VACUUM CLEANER AND VACUUM CLEANING SYSTEM AND METHODS OF USE IN A RAISED FLOOR ENVIRONMENT

CROSS REFERENCE TO RELATED APPLICATIONS

This application claims priority under 35 U.S.C. §119 to Poland Provisional Application No. P.394570 entitled "ROBOT FOR RAISED ACCESS FLOORING AND THE METHOD OF ITS SERVICING," filed on Apr. 15, 2011, and claims priority under 35 U.S.C. §119(e) to U.S. Provisional Application Ser. No. 61/522,902 entitled "VACUUM CLEANER AND VACUUM CLEANING SYSTEM AND METHODS OF USE," filed on Aug. 12, 2011, which are both incorporated herein by reference in their entirety.

BACKGROUND OF THE INVENTION

1. Field of Disclosure

One or more aspects of the present disclosure relate generally to vacuum cleaners, and more particularly to remote controlled, autonomous, or semi-autonomous vacuum cleaners.

2. Discussion of Related Art

Vacuum cleaners have long been used for cleaning a variety of different surfaces. However, efficiently and effectively cleaning certain surfaces, especially hard-to-reach surfaces, remains a challenge in the field, especially in small or confined spaces. Specifically, it is a challenge to clean underneath raised access floorings, especially Tec Crete® type raised flooring offered by Haworth, Inc. of Holland, Mich. Raised access flooring is a practical solution for installing cabling and distribution of various installations in buildings and rooms. Raised access flooring consists usually of panels supported by posts placed on the actual floor of the room. The space between the panels and the actual floor can be equipped with power, voice, computer, alarm or air cables, for example. Because of safety and hygienic reasons, it is necessary to periodically clean the space under the raised access flooring. Currently, it is necessary to remove a large number of panels to clean the space using traditional vacuum cleaners under the panels, and in close area. It is estimated that about 20-30% of panels should be removed to clean the whole surface thoroughly. In a work environment, the cleaning of surfaces under raised access flooring can be performed only on weekends and at nights. Moreover, it is difficult to locate and remove large objects under such flooring, such as dead animals.

BRIEF SUMMARY OF THE INVENTION

A first aspect of the disclosure is directed to a vacuum cleaner, which is designed to be used in a raised floor environment. The vacuum cleaner includes a body, a power source supported by the body, a vacuum module supported by the body and configured to intake air and exhaust air, and a drive module supported by the body. The body includes an outer casing. The outer casing has channels configured to divide and channel exhaust flow and to direct exhaust flow in multiple directions.

Embodiments of the vacuum cleaner further may include a controller supported by the body. In a certain embodiment, the controller may be configured to control the operation of the power source, vacuum module and drive module. The vacuum cleaner further may include an infrared sensor supported by the body. The infrared sensor may be coupled to the processor and configured to detect objects proximate to the body of the vacuum cleaner. The controller may be configured to send and receive signals from the infrared sensor to detect objects. The drive module may include two wheels on a left side of the vacuum cleaner, two wheels on a right side of the vacuum cleaner, and independent drive systems for the left side and the right side configured to allow the vacuum to turn in place. The vacuum module may include a suction module, a dustbin, a pump, and a filter, supported by the body. The suction module may be removable. In a certain embodiment, the pump has a power capacity between about 300 watts and about 1500 watts. The vacuum cleaner further may comprise a sound module. In one embodiment, the power source is a battery selected from the group consisting of a lithium-ion polymer battery and a lithium-ferrum battery. The battery has a voltage of about 22 volts to about 24 volts. The vacuum cleaner further may comprise an electronic amplifier in electrical communication with the power source, wherein the electronic amplifier is capable of converting a voltage from about 22 to 24 volts to a voltage of greater than 200 volts. The vacuum cleaner further may comprise at least one video camera supported by the body. The vacuum cleaner further may comprise a light supported by the body. In one embodiment, the light is a light-emitting diode. The vacuum cleaner further may comprise a communications module supported by the body. In one embodiment, the communications module comprises a receiver supported by the body and a transmitter supported by the body. The communications module may comprise a transceiver supported by the body. The vacuum cleaner further may comprise a video recording device supported by the body. The vacuum cleaner may be autonomous. In some operations, the vacuum cleaner may be remotely controlled.

Another aspect of the disclosure is directed to a vacuum cleaning system, which is designed to be used in a raised floor environment. The vacuum cleaning system includes a vacuum cleaner includes having a body, a drive module supported by the body, and a vacuum module supported by the body. The vacuum module is configured to intake air and exhaust air. The vacuum cleaner also includes a controller supported by the body. The controller is configured to control operation of the power source, vacuum module and drive module, and an infrared or inductive sensor supported by the body. The infrared or inductive sensor is coupled to the processor and configured to detect objects proximate to the body of the vacuum cleaner. The controller is configured to send and receive signals from the infrared, or inductive, sensor to recognize pre-designated objects. The vacuum cleaning system further comprises a remote control module in operative communication with the communication module of the vacuum cleaner.

Embodiments of the vacuum cleaning system further may comprise a transmission-receiver module in operative communication with the communication module of the vacuum cleaner and the remote control module. In a certain embodiment, the communications module of the vacuum cleaner includes a transmitter configured to deliver a radio signal receivable by the transmission-receiver module and a receiver configured to receive a radio signal from the transmission-receiver module. The communications module of the vacuum cleaner further may comprise a cable attached to the vacuum cleaner and the transmitter-receiver module. The cable may be configured to transmit information to and receive information from the transmitter-receiver module. The communications module of the vacuum cleaner further may include a transmitter configured to deliver a radio signal receivable by the remote control module and a receiver configured to receive a radio signal from the remote control module. The remote control module further may comprise a transmitter configured to deliver a radio signal receivable by the vacuum cleaner and a receiver configured to receive a radio signal from the vacuum cleaner. The communications module of the vacuum cleaner further may include a cable attached to the vacuum cleaner and the remote control module. The cable may be configured to transmit information to and receive information from the remote control module. The remote control module may be a computer. The vacuum cleaner system further may comprise a hand-held remote control.

Another aspect of the disclosure is directed to a method of cleaning a raised access flooring system. The method includes providing a vacuum cleaner used in a raised floor environment, the vacuum cleaner comprising a body, a power source supported by the body, a vacuum module supported by the body, the vacuum module being configured to intake air and exhaust air, a drive module supported by the body, the body including an outer casing, the outer casing having channels configured to divide and channel exhaust flow and to direct exhaust flow in multiple directions, placing the vacuum cleaner into a space formed between an original floor and a plurality of raised panels of the raised access flooring system, and operating the vacuum cleaner to perform a cleaning operation.

Embodiments of the method further may include providing a vacuum cleaner includes providing an autonomous vacuum cleaner. The method further may comprise remotely controlling at least some operations of the vacuum cleaner. In one embodiment, providing a vacuum cleaner may include providing a vacuum cleaner having a controller supported by the body, the controller being configured to control the operation of the power source, vacuum module and drive module. In another embodiment, providing a vacuum cleaner may include providing a vacuum cleaner having an infrared sensor coupled to the processor and configured to detect objects proximate to the body of the vacuum cleaner. In yet another embodiment, providing a vacuum cleaner may include providing a vacuum cleaner having a controller configured to send and receive signals from the infrared sensor to detect objects.

Another aspect of the disclosure is directed to a method of channeling exhaust air from a vacuum cleaner, which is designed for use in a raised floor environment. The method includes providing a vacuum cleaner comprising a body, a power source supported by the body, a vacuum module supported by the body, the vacuum module being configured to intake air and exhaust air, a drive module supported by the body, the body including an outer casing, the outer casing having channels configured to divide and channel exhaust flow and to direct exhaust flow in multiple directions. The method also includes performing a cleaning operation with the vacuum cleaner.

Another aspect of the disclosure is directed to a method of cleaning an underfloor air distribution system comprising deploying a vacuum cleaner for raised floor environments in a space between an original floor and a plurality of raised panels supported by a plurality of regularly spaced posts, and manipulating a path of travel of the vacuum cleaner.

Embodiments of the method may further include configuring the vacuum cleaner to be remotely controlled. In a certain embodiment, the vacuum cleaner is an autonomous vacuum cleaner. Manipulating a path may include remotely controlling the path of travel of the vacuum cleaner. Manipulating a path may include pre-programming the path of travel of the vacuum cleaner.

BRIEF DESCRIPTION OF THE DRAWINGS

Various aspects of at least one embodiment are discussed below with reference to the accompanying figures, which are not intended to be drawn to scale. Where technical features in the figures, detailed description or any claim are followed by references signs, the reference signs have been included for the sole purpose of increasing the intelligibility of the figures, detailed description, and claims. Accordingly, neither the reference signs nor their absence are intended to have any limiting effect on the scope of any claim elements. In the figures, each identical or nearly identical component that is illustrated in various figures is represented by a like numeral. For purposes of clarity, not every component may be labeled in every figure. The figures are provided for the purposes of illustration and explanation and are not intended as a definition of the limits of the disclosure. In the figures:

FIGS. 6A-6H are various views of the vacuum cleaner;

DETAILED DESCRIPTION OF THE INVENTION

Figure 1:
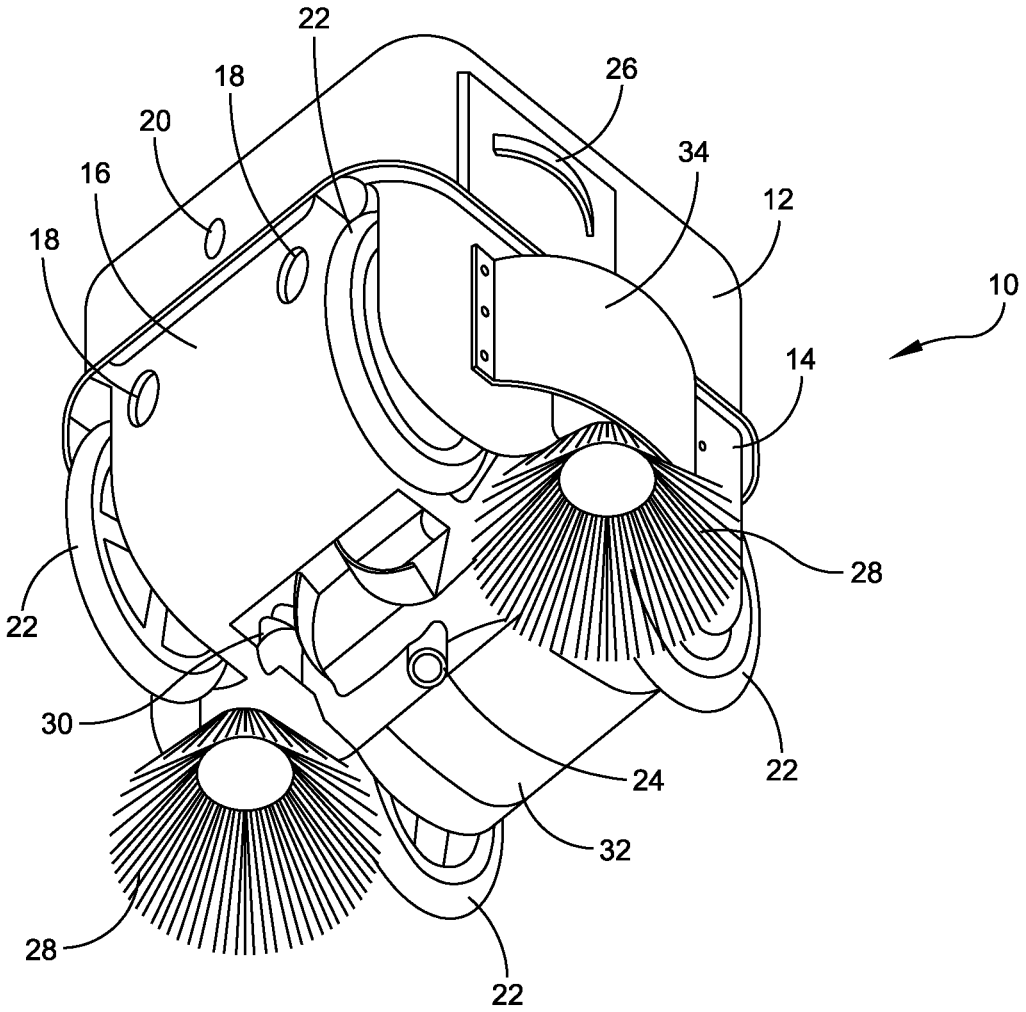
FIG. 1 is a bottom perspective view of a vacuum cleaner of an embodiment of the present disclosure.

It is to be appreciated that embodiments of the systems and methods discussed herein are not limited in application to the details of construction and the arrangement of components set forth in the following description or illustrated in the accompanying drawings. The methods and apparatuses are capable of implementation in other embodiments and of being practiced or of being carried out in various ways. Examples of specific implementations are provided herein for illustrative purposes only and are not intended to be limiting. In particular, acts, elements and features discussed in connection with any one or more embodiments are not intended to be excluded from a similar role in any other embodiments.

Also, the phraseology and terminology used herein is for the purpose of description and should not be regarded as limiting. Any references to embodiments or elements or acts of the systems and methods herein referred to in the singular may also embrace embodiments including a plurality of these elements, and any references in plural to any embodiment or element or act herein may also embrace embodiments including only a single element. References in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation.

In accordance with one or more embodiments, a novel vacuum cleaner, which is designed for raised floor environments, may allow for more thorough cleaning of a space, while reducing the amount of labor involved in that cleaning. Beneficially, the improved vacuum cleaner may create a more sanitary environment. The improved vacuum cleaner may also reduce the labor involved in cleaning and may provide fewer interruptions to those working, living, or recreating in the area of the cleaning. Cost savings to, for example, building managers or building tenants may accrue through the use of the novel vacuum cleaner. The health of those occupying the cleaned space may be improved through the improvement to the sanitation of an environment provided by the novel vacuum cleaner.

In accordance with one or more embodiments, the novel vacuum cleaning system may, likewise, allow for more efficient and more thorough cleaning of an environment. The improved vacuum cleaning system may involve providing a remote control station, or remote control module, where an operator may remotely oversee the operation of the vacuum cleaner. Information may be sent to and from the vacuum cleaner and the remote control module. The vacuum cleaning system may further comprise a receiver-transmitter station, or module, which facilitates communication between the vacuum cleaner and the remote control station.

Vacuum cleaners may be used in a variety of settings to clean a variety of surfaces. Vacuum cleaners may be used to clean homes, automobiles, offices, and a variety of other spaces. For example, the vacuum may be used to clean the space above a ceiling, or the vacuum may be used to clean the space underneath raised flooring.

Raised access floor systems are a practical solution for locating, installing, and managing cabling, ducting, and systems, such as a ventilation system. A raised access floor system consists usually of panels based on posts placed on the original floor of the room. The vertical distance between the building floor and panels may vary; as may the horizontal distance between posts. However, industry standards do provide some uniformity in the design of certain raised access flooring systems. For example, industry standards for a particular type of raised access floor systems called Underfloor Air Distribution (UFAD systems) call for a 24-inch space between posts in a horizontal grid pattern.

In a raised access floor system, the space between the panels and the actual floor can be equipped with cables used for a variety of purposes and may include power cables, computer cables and alarm cables. In underfloor air distribution (UFAD) systems, the space between the panels and the actual floor is used to provide an accessible and adjustable heating, ventilation, and air conditioning (HVAC) network.

UFAD systems are an important tool for providing HVAC requirements in an energy efficient manner to conserve overall energy use. UFAD systems provide space conditioning in offices and other commercial buildings as an alternative to conventional ceiling-based air distribution systems. However, for these systems to be a viable option, the air provided by such systems must be healthy and safe. Vacuuming the floor space may contribute to providing clean and sanitary air, because vacuuming removes particulate matter, such as dust or organic matter, from entering the airstream. Thus, for safety and hygienic reasons, it is desirable to periodically clean the space under the raised access floor system. The space used in UFAD systems is also used to locate cables and wires necessary for other building and tenant operations.

Currently, it is typically necessary to remove a large number of panels to reach and clean the space beneath a raised floor using traditional vacuum cleaners. For example, it is estimated that about 20-30% of the panels should be removed to clean the whole surface under the panels thoroughly. Such a labor-intensive effort is expensive and interrupts any activity taking place in the room, such as office work. Often the cleaning may only be performed on weekends and nights.

Furthermore, if there are dead animals, by-products, animal feces, insects, dirt or debris under the floor panels, these objects may be difficult to find, thus, potentially creating an unsanitary situation.

Certain embodiments of the present disclosure provide improvements to cleaning in general, particularly, to cleaning the space underneath panels in a raised access flooring system, such as a UFAD system.

The body of the vacuum cleaner, which is designed for use in raised floor environments, may be sized to fit into the space between posts in a standard UFAD system. The vacuum cleaner may be wide enough to cover the entire path between two posts, so that it may clean that path in a single pass. The height of the vacuum cleaner may be low enough to fit into the limited vertical space between the original floor and the floor panels even where cabling is present. The body of the vacuum cleaner may be equipped with a handle to facilitate carrying the vacuum cleaner.

An outer casing may surround the body of the vacuum cleaner. This outer casing may be smooth so as to avoid snagging wires or cables present in the floor space.

The vacuum module of the vacuum cleaner may provide powerful suction to thoroughly remove dust, dirt, and other debris. The vacuum module may comprise a suction module, a pump, a dustbin, and a filter.

The suction module may comprise an air intake port and an air exhaust port.

The air intake port may be located on the bottom side of the vacuum cleaner. The surrounding body of the intake port may be fixed or rigid on the underside of the vacuum cleaner or it may be flexible or movable or loose or pliable or spring-loaded, so as to enable the vacuum cleaner to traverse wires and cables on the floor without getting snagged. Even where the surrounding body of the air intake port is not rigidly fixed to the bottom side of the vacuum cleaner, it nevertheless maintains an uninterrupted flow path so as not to decrease air pressure or sacrifice suction force.

The air exhaust port may be located on the top side of the vacuum cleaner. Various configurations of the exhaust port may be designed to break up the air flow or to otherwise limit the force of the air flow coming out of the exhaust port. Air flow from the exhaust port can stir up dirt in a manner counterproductive to the purpose of vacuuming Therefore, improvements that limit the stir-up effect of exhaust flow are valuable contributions over the prior art.

In certain embodiments of the present disclosure, design features may limit counterproductive stir-up by inhibiting the force of the air flow coming out of the exhaust port. The vacuum cleaner may, for example, possess an air flow dissipation module. For example, the flow path leading to or from the exhaust port may contain twists and turns, or an otherwise tortuous path, to interrupt the air flow. Furthermore, the outer casing surrounding the exhaust port may have channels configured to divide and channel exhaust flow and to direct exhaust flow in multiple directions. In conjunction with the exhaust flow channels, a plate may be placed about the exhaust exit, interrupting a direct flow path out of the exit port and causing the flow to disperse in multiple directions around the cap and through provided channels on the surface of the vacuum cleaner. In this and other manners, design configurations may limit the stir up of dust created by exhaust flow.

The pump may be a powerful pump to create a strong vacuum and increase the cleaning power of the vacuum cleaner. The pump may, for example, have a power capacity of between 300 W and 1500 W. The power of the pump allows the vacuum to draw up, for example, dust, small stones, and debris.

The vacuum module may be equipped with a filter which functions to prevent particulate matter from escaping out of the exhaust port. The filter may be, for example, a high-efficiency particulate air (HEPA) filter.

The dust and dirt sucked up by the vacuum cleaner may ultimately be deposited in a dustbin. The dustbin may be connected to the vacuum cleaner by a number of means. For example, the dustbin may be fastened to the vacuum cleaner by magnets, facilitating the easy attachment and removal of the dustbin when the dustbin becomes full.

The vacuum may be equipped with side brushes that help to sweep dirt and dust toward the suction unit. The vacuum may also be equipped with a rotating cylindrical brush in front of the suction unit, which aids in loosening dirt and dust allowing it to be pulled into the suction unit. These brushes can rotate in both directions to untangle wires. The brushes may be flexible to help the vacuum cleaner travel past obstacles in its path.

The vacuum cleaner may be equipped with a germicidal UV lamp for killing germs and making the space more sanitary.

The vacuum cleaner may be equipped with an arm, or other manipulating device, capable of picking up small objects. These small objects may be, for example, dead rodents or other objects that cannot be drawn in by the suction unit. This arm may help free the way in front of the vacuum cleaner.

The vacuum cleaner may be equipped with a drive module. The drive module of the vacuum cleaner may include four motor-driven wheels connected to the body of the vacuum cleaner to provide mobility. The wheels may include two left wheels and two right wheels. The left wheels and right wheels may function independently of each other. There may be a separate motor controlling the two left wheels and a separate motor controlling the two right wheels. Independent drive systems for the left wheels and right wheels may for example allow the left wheels to move forward, while the right wheels operate in reverse. If both the left wheels and the right wheels are engaged in forward motion, then the vacuum cleaner will move in the forward direction. If the left wheels are engaged in forward motion, and the right wheels are engaged in reverse motion, then the vacuum cleaner may turn right. If the left wheels are engaged in reverse motion and the right wheels are engaged in forward motion, then the vacuum cleaner may turn left. If both the left wheels and the right wheels are engaged in reverse motion, then the vacuum cleaner will move in the backwards direction. The wheels of the vacuum cleaner may be equipped with tread that facilitates overcoming obstacles in the path of the vacuum cleaner. In some embodiments the wheels of the vacuum cleaner may have a caterpillar tread connecting the left front wheel with the left rear wheel, and the right front wheel with the right rear wheel. In some embodiments there may be more than four wheels, for example six wheels, or eight wheels, or more.

A variety of power sources may power the vacuum cleaner. For example, the vacuum cleaner may be powered through battery power. The vacuum cleaner may be powered by one battery or by more than one battery. The type of battery used to power the vacuum cleaner may be a lithium-ion polymer battery or a lithium-ferrum battery. The battery may have a capacity of 5000 milliamp hours (mAh) or greater. Removable batteries may be charged in an external charger. The use of exchangeable battery packs may assure continuous operation of the vacuum cleaner.

The vacuum cleaner may be equipped with a communications module. The communications module may comprise a receiver and a transmitter or a transceiver for communicating with a remote control station or a remote control module or for communicating with an intermediate module such as a transmitter-receiver station. The communications module may also comprise a shielded cable that connects to a remote control module, or a transmitter-receiver station.

The vacuum cleaner may be equipped with a controller or processor. The controller may control and monitor certain functions of the vacuum cleaner. The controller may store information or data or transmit that information or data. The controller may be used to program into the memory of the vacuum certain information, such as the path it will travel. The controller or processor may be used to store recorded video of a cleaning event, or the path traveled during a cleaning event. The controller may be used to gather and record important operating information about the vacuum, such as battery level, charging history, garbage amount, temperature, humidity, pressure, and other measurements. This information may be either stored or transmitted to a remote location.

The controller may be used to pre-program a vacuum cleaner with a path of operation, thus allowing the vacuum cleaner to operate autonomously while cleaning. The controller may be used in conjunction with sensors, such as inductive or infrared sensors, or other image recognition means, to detect and count regularly spaced posts that the vacuum cleaner passes to orient and track its location. In this way as well, the vacuum cleaner may be able to operate autonomously. Navigation may be based on odometry supported by accelerometer and gyroscope readings. Post locations may be used as a corrective mechanism to correct for errors in the navigation system. Image recognition software may be used to detect and recognize objects. The location of these objects could then be used to create a map of the underfloor environment.

Furthermore, the controller may be used to facilitate a mapping for marking areas to be cleaned, areas that are already cleaned, and areas that are impossible to clean. The operator of the vacuum may then mark specific zones on a map for further manual inspection or cleaning. The map may contain reference to video recorded during inspection or cleaning. The user can then point to an area on the map to watch corresponding video.

At least one vacuum cleaning system of one embodiment includes a docking station for automatic charging of the vacuum cleaner and emptying of the dustbin to facilitate the autonomous or semi-autonomous operation of the vacuum cleaner. The docking station may be located under a raised floor to allow the vacuum cleaner to automatically mate with the docking station, or the docking station may be at another location and require an operator to place the vacuum cleaner in the docking station.

The vacuum cleaner may be equipped with a sound module for emitting a sound, should, for example, the vacuum cleaner become immobilized. In such an instance, the remote station can send a command to the vacuum cleaner to sound an alarm so that the person walking over the floor may find the source of the sound thus locating the vacuum cleaner. Such a sound emission could be used as an alternative to other location-finding methods.

The vacuum cleaning system may comprise a vacuum cleaner containing various features described above and a remote control station. The remote control station, or remote control module, may comprise a computer, for example, a laptop computer, or tablet device, or a smart-phone, or other computer-like apparatuses. The movement and other operations of the vacuum cleaner may be controlled at the remote control station. A human operator at the control station may control the activity of the vacuum cleaner through, for example, the use of a computer keyboard, or through the use of a hand-held remote control. The remote control may resemble the remote control used in conjunction with commercial gaming consoles. The remote control may be physically attached to a computer, or it may be a wireless remote control.

The vacuum cleaning system may further comprise a transmitter-receiver station, or more than one transmitter-receiver stations. A transmitter-receiver station may relay information from the vacuum to the remote station, or vice versa. A transmitter-receiver station can improve the strength of signal between the vacuum and the remote station, and allow the distance between the vacuum and the remote station to be increased. The signal transmitted and received between the vacuum and remote station may be a radio or WiFi signal. The WiFi signal may be relayed at various access points located in different parts of a building or office to extend the range of communication between the vacuum and the remote station. The signal range between the vacuum and remote control station may be extended by, for example, using multiple wireless routers working in repeater mode.

The vacuum cleaner may transmit information to the remote control module to facilitate an operator's operation of the vacuum cleaner. For example, the vacuum cleaner may transmit to the remote station video of its operation. Video cameras may be placed on the vacuum cleaner. For example, a video camera may be placed on the front end of the vacuum cleaner, or a video camera may be placed on the rear end of the vacuum cleaner. These video cameras may have a fish-eye lens providing a large swath of coverage. This video may also be recorded and stored by the vacuum cleaner.

The operator may monitor the activity of the vacuum cleaner with the aid of video transmission from the vacuum cleaner. The vacuum cleaner may be equipped with lights, for example, light emitting diodes, in both the front and rear of the vacuum cleaner. The LED lights may have panning and tilting capabilities. The may also have dimming ability. These lights can be used to illuminate objects and debris on the floor. Used in conjunction with the video cameras, the lights help a remote operator direct the vacuum cleaner on its path, or facilitate useful video recording of the path.

FIG. 1 shows a bottom front-left perspective view of a vacuum cleaner, generally indicated at 10, of an embodiment of the present disclosure. An outer casing of the vacuum cleaner 10 is composed of an upper outer casing 12 and a lower outer casing 14. On a front end 16 of the vacuum cleaner 10 are two lights, each indicated at 18. The lights 18 may be, for example, light emitting diodes (LEDs). On the front end 16 of the vacuum cleaner 10 is also a video camera 20. The video camera 20 may be used to monitor the activity of the vacuum cleaner and the path in front of the vacuum cleaner. Video obtained by the video camera 20 may be either transmitted to a remote monitor (not pictured) or it may be recorded, or both. The vacuum cleaner moves through the use of wheels, each indicated at 22. Each of the wheels 22 may have tread to help move over obstacles such as cables or wiring.

On the bottom of the vacuum cleaner is a vacuum air intake 24. The vacuum air intake 24 draws in air along with dirt, and dust and other particles to clean a surface upon which the vacuum cleaner 10 travels. The vacuum effect is created by a pump (not shown) inside the vacuum cleaner 10. The pump is powered by a battery 26. Side brushes, each indicated at 28, and a front brush 30, aid in moving dirt into the vacuum air intake 24. The dirt and debris collected by the vacuum are ultimately deposited in a dustbin 32. The rounded design of the outer casing (upper and lower outer casings 12, 14) is configured to prevent the vacuum cleaner from snagging on any objects, such as wires or cables. Side guards, one of which is indicated at 34 in FIG. 1, are provided to prevent wires or cables from becoming tangled in the side brushes 28.

Figure 2:
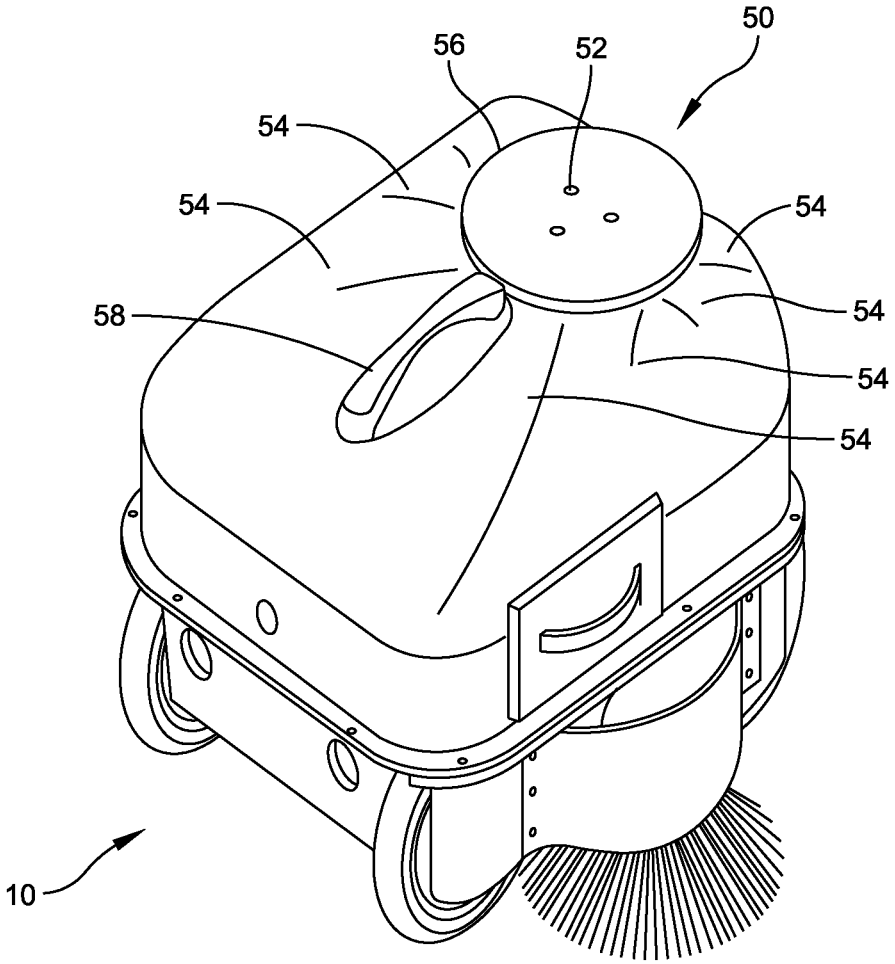
FIG. 2 is a top perspective view thereof.

FIG. 2 shows a top front left perspective view of an embodiment of the vacuum cleaner 10. On the upper outer casing 12 is an air flow dissipation module, generally indicated at 50. The air flow dissipation module 50 is designed to disperse the flow of air exiting the exhaust port (not shown in FIG. 2) of the vacuum cleaner 10. An upper dissipation plate 56 blocks the air flow from the exhaust port and redirects the air flow into channels 54 embedded in the upper casing 12 of the vacuum cleaner 10. These channels 54 in the upper outer casing 12 are configured to divide and channel exhaust flow and to direct exhaust flow in multiple directions. Bolts, each indicated at 52, are provided to connect the upper dissipation plate 56 to the vacuum cleaner 10 in a position over the exhaust port.

Figure 3:
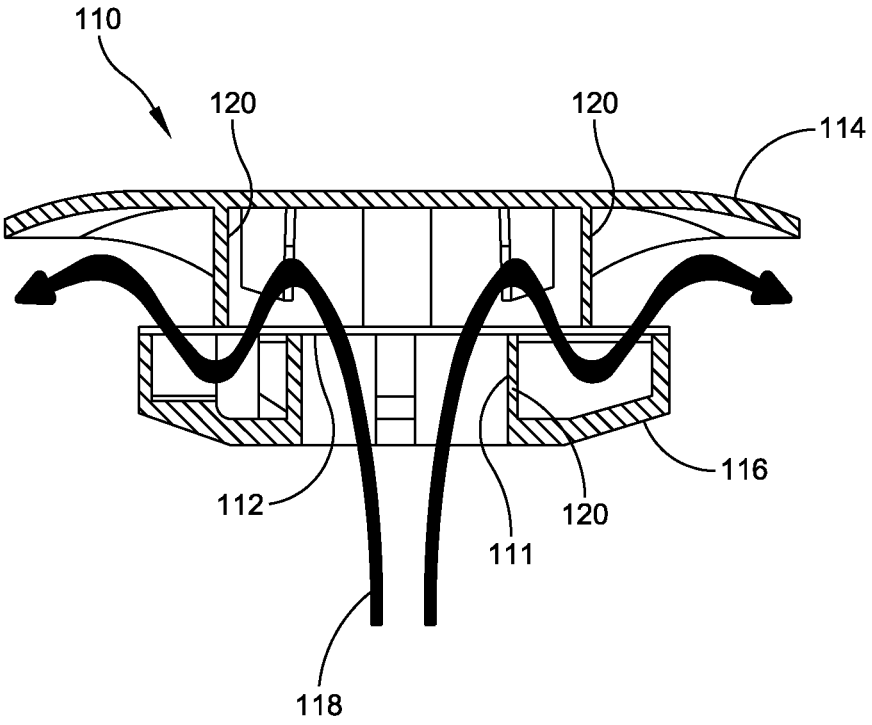
FIG. 3 is a cross-sectional view of an air flow dissipation module of the vacuum cleaner.
Figure 4:
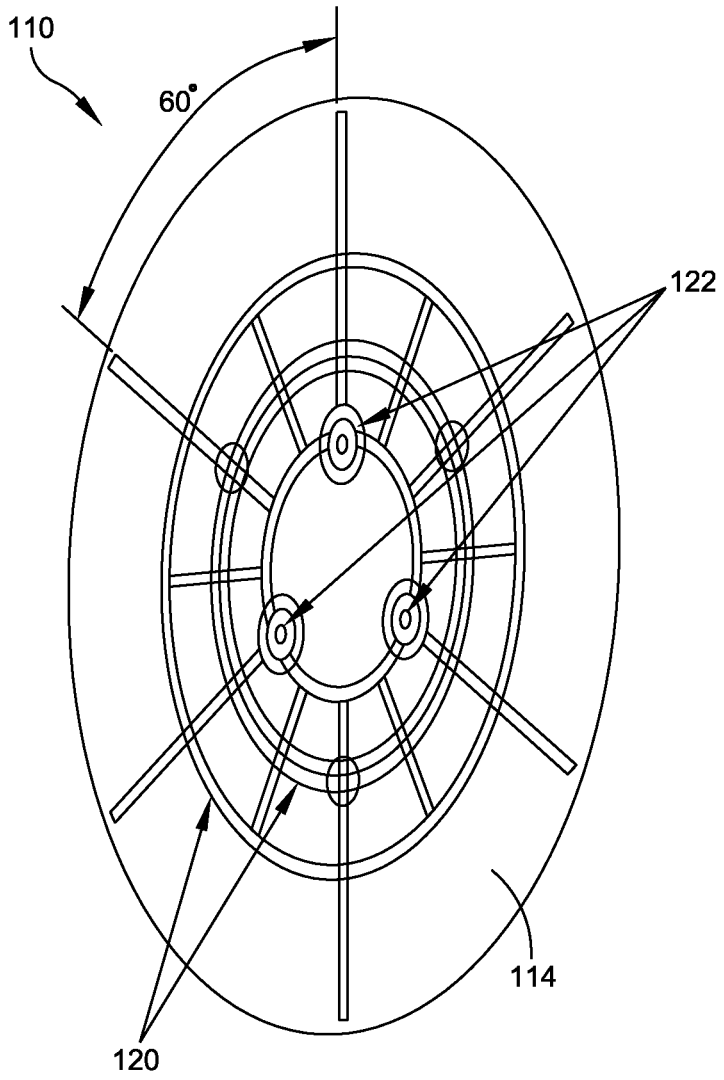
FIG. 4 is a top view of the air flow dissipation module.
Figure 5:
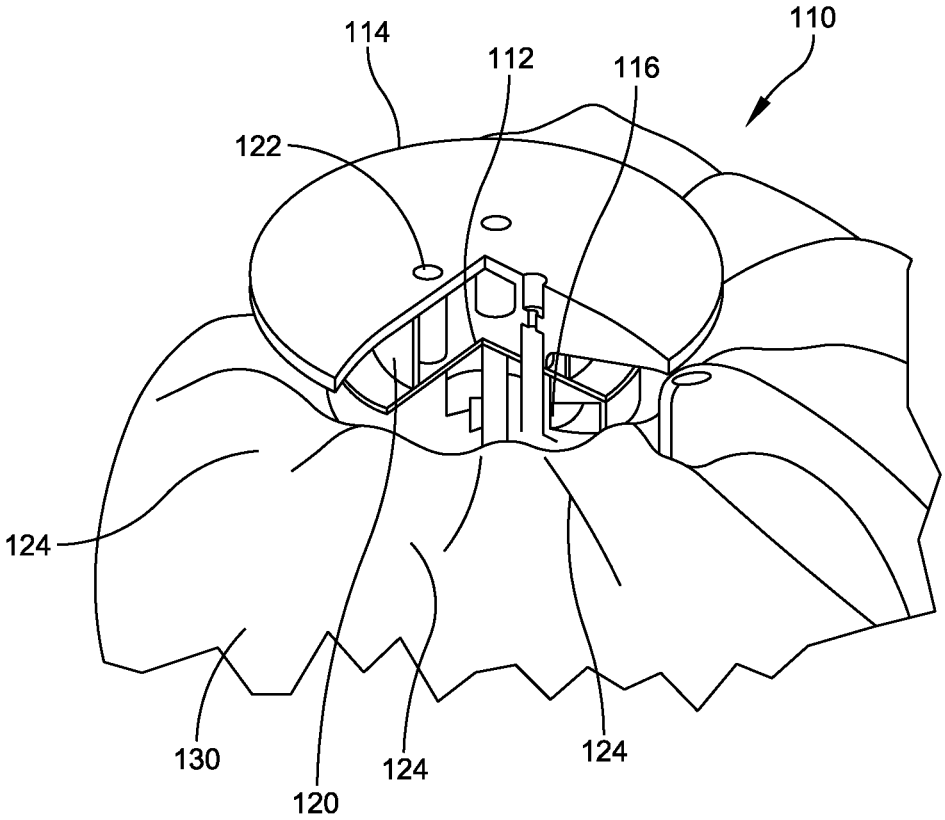
FIG. 5 is a perspective view of the air flow dissipation module.

FIGS. 3-5 show an exemplary air flow dissipation module, generally indicated at 110, in further detail.

FIG. 3 provides a side cross-sectional view of the air flow dissipation module 110. An air flow stream indicated by arrows 118 exits the exhaust port 111 and passes through a filter 112. The filter 112 may be, for example, a HEPA filter. The upper dissipation plate 114 blocks the direct flow of the air flow stream 118 Inhibiting rings, each indicated at 120, further interfere with the direct flow of the air flow stream 118 causing further dissipation of the force of the air flow stream 118. A bottom dissipation plate 116 provides another barrier to the air flow stream 118 exhausted by the vacuum cleaner.

FIG. 4 provides a top view of the air flow dissipation module 110. The upper dissipation plate 114 is connected to the vacuum cleaner by bolts 122 Inhibiting rings 120 extending down from the upper dissipation plate 114 and up from the bottom dissipation plate (not shown in FIG. 4).

FIG. 5 provides a perspective view of the air flow dissipation module 110. Bolts 122 fasten the upper dissipation plate 114 and the lower dissipation plate 116 to the vacuum cleaner. Exhaust flows out of the vacuum cleaner through the filter 112 and twists and turns through the inhibiting rings 120 and upper dissipation plate 114 and lower dissipation plate 116. The exhaust air flow is finally directed in multiple directions through the dissipation channels, each indicated at 124, on an outer casing 130 of the vacuum cleaner.

FIGS. 6A-6H present further perspectives and views of the vacuum cleaner 10 and contain some of the same features and components as those shown and described with reference to FIGS. 1 and 2.

Figure 7A:
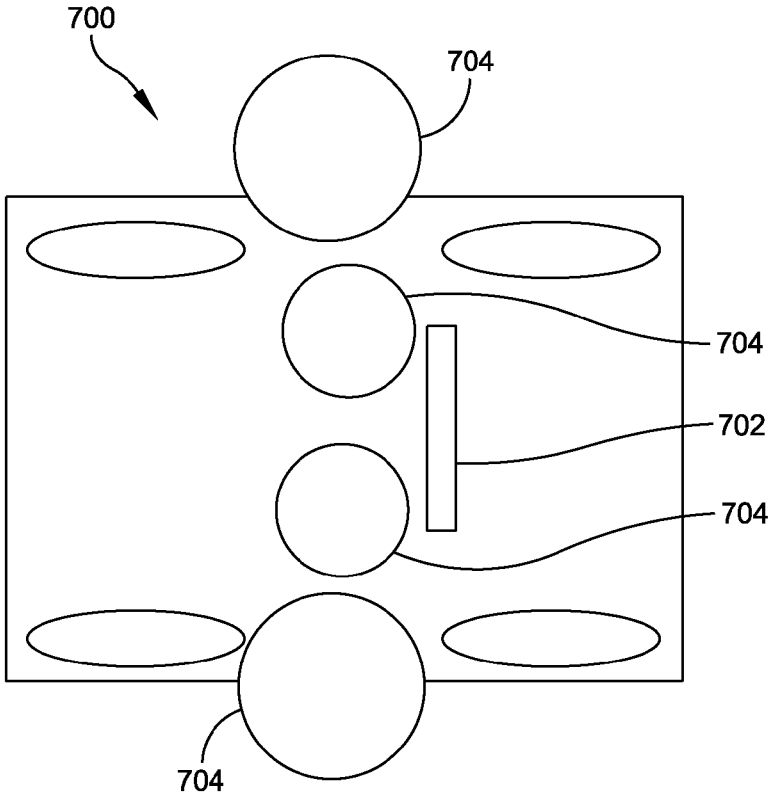
FIGS. 7A and 7B are bottom and side views of a vacuum module of a vacuum cleaner of an embodiment of the present disclosure.
Figure 7B:
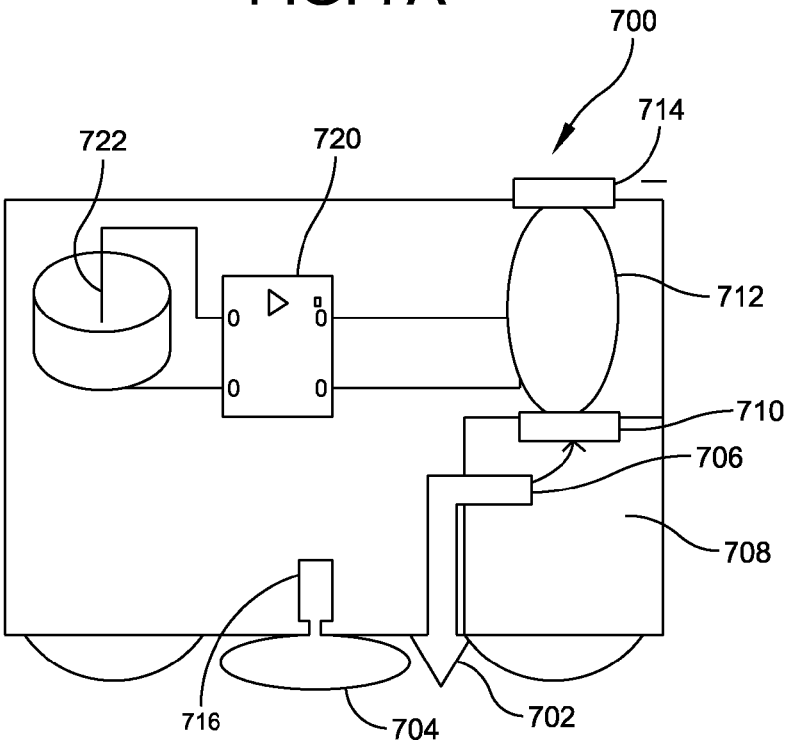

FIGS. 7A and 7B illustrate a vacuum module, generally indicated at 700, which is provided to draw air into the vacuum cleaner and associated debris, and to exhaust filtered air from the vacuum cleaner. As shown, the vacuum module includes an outside suction module 702, a pair of brushes, each indicated at 704, an inside suction module 706, a dust container 708, a dust filter 710, a pump/blower 712, an exhaust element 714, and a drive motor 718 for each brush. The brushes 704 are designed to loosen debris, which is sucked into the suction modules 702, 706 by the pump 712. The air containing the debris is trapped by the filter 710 and captured within the dust container 708. The vacuum module further includes an electronic amplifier 720 and a battery pack 722. The amplifier 720 amplifies the power generated by the battery pack 722 to power the operation of the components of the vacuum cleaner.

Figure 8A:
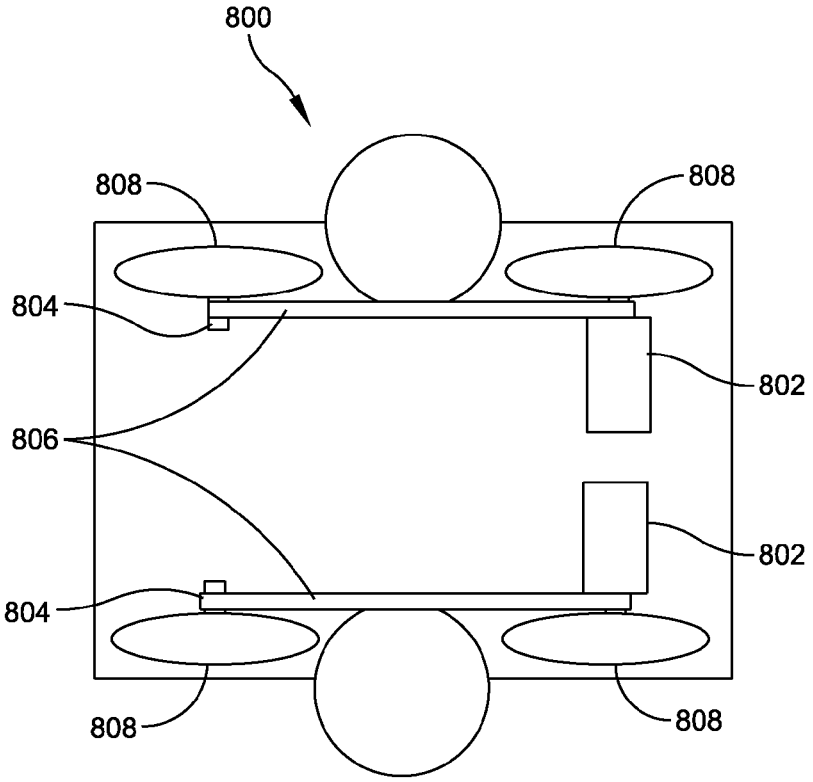
FIGS. 8A and 8B are bottom and side views of a drive module of a vacuum cleaner of an embodiment of the present disclosure.
Figure 8B:
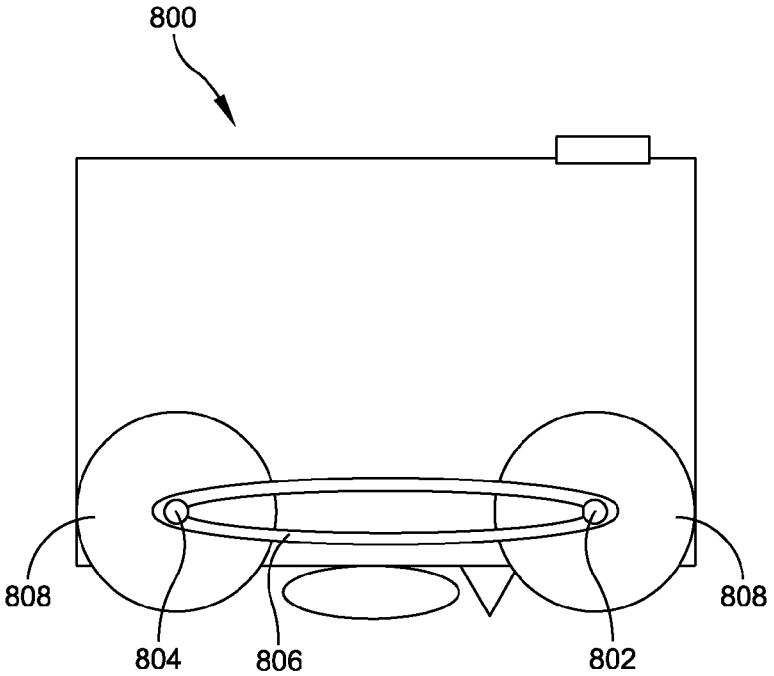

FIGS. 8A and 8B illustrate a drive module, generally indicated at 800, which is provided to drive the rotation of the wheels of the vacuum cleaner. As shown, the drive module 800 includes two drive motors, each indicated at 802, two axles, each indicated at 804, two power transmission belts, each indicated at 806, and four wheels, each indicated at 808. The motors 802 drive the rotation of the front wheels 808, with the transmission belt 806 driving the rotation of the rear wheels 808. The motors 802 and the axles 804 are suitably secured to the housing of the vacuum cleaner.

Figure 9:
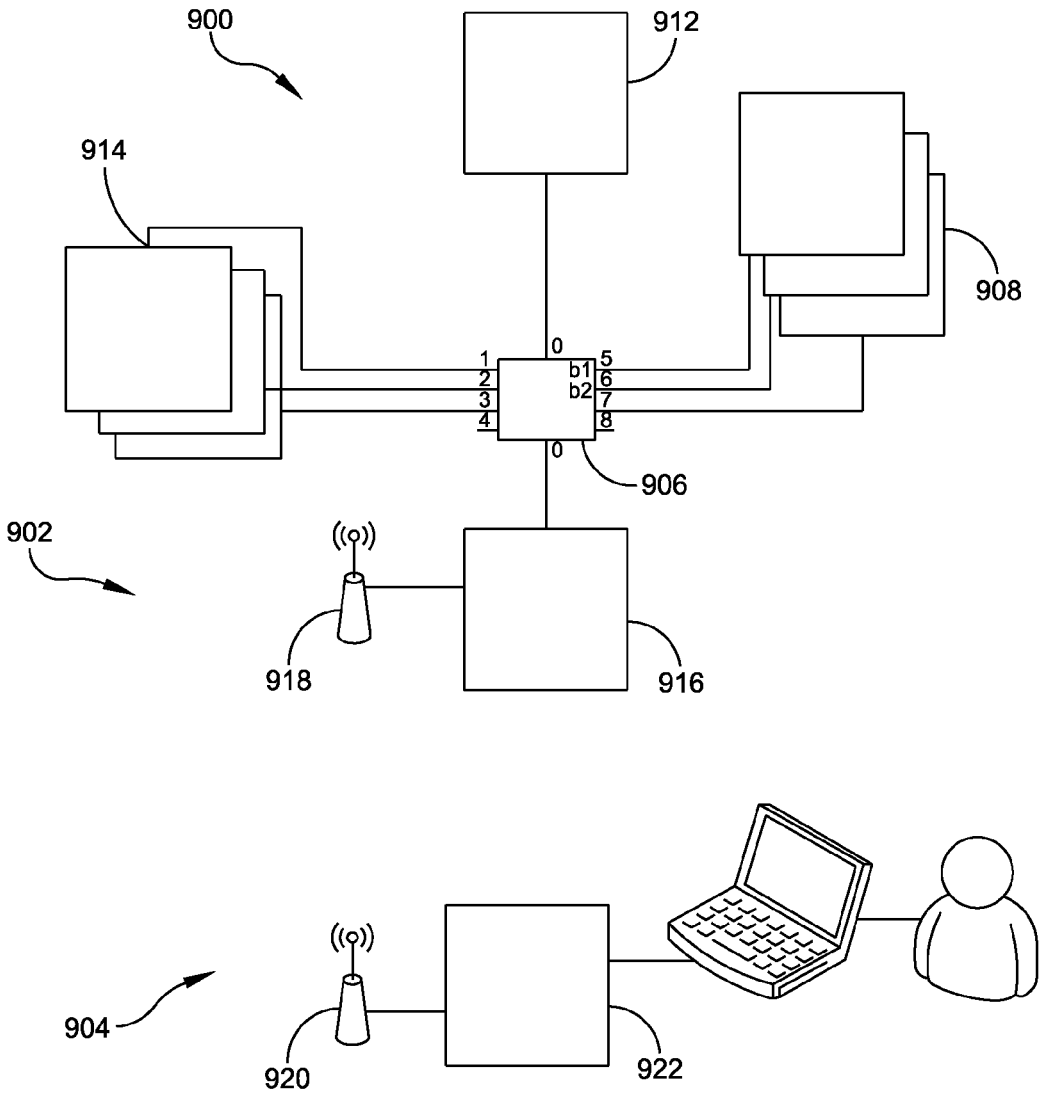
FIG. 9 is a schematic view of a controller, a communication module, and a remote control module of an embodiment of the present disclosure.

FIG. 9 illustrates a controller, generally indicated at 900, a communication module, generally indicated at 902, and a remote control module, generally indicated at 904. The controller 900 is provided for controlling the operation of the vacuum cleaner. As shown, the controller 900 includes a microcomputer 906 connected to all of the electronic components of the vacuum cleaner, effectors 908 (e.g., motors, pump, lights, buzzer, etc.), rechargeable batteries, each indicated at 912, and sensors 914 (e.g., infrared, motor encoders, battery status sensors, etc.). The communication module 902 provides communication to and from the vacuum cleaner and a remote device, such as the remote control module 904. As shown, the communication module 902 includes a transmitter/receiver 916 and an antenna 918 for data transmission. The transmitter/receiver 916 of the communication module 902 is connected to the microcomputer 906 of the controller 900. The remote control module 904 controls the operation of the vacuum cleaner by means of the controller 902 and communication module 904. As shown, the remote control module includes an antenna 920 for data transmission and a control station 922, which may include a laptop, personal computer, keyboard, mouse, etc.

Figure 10:
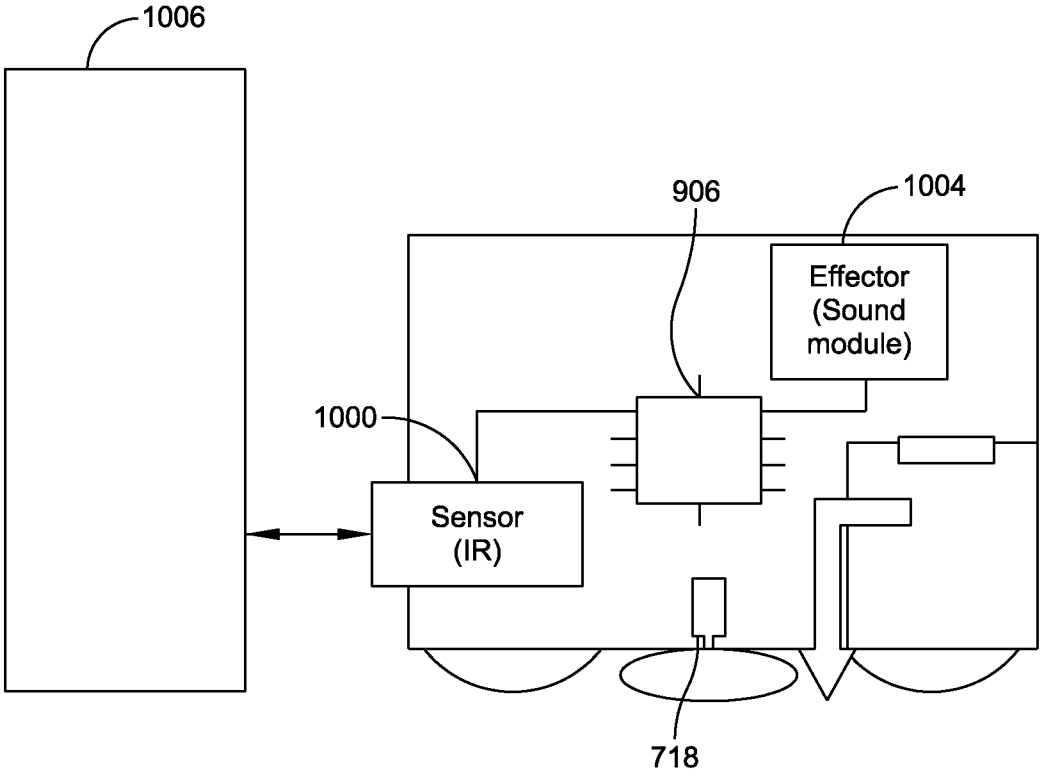
FIG. 10 is a schematic view of an infra red sensor and a sound module of an embodiment of the present disclosure.

FIG. 10 illustrates an infrared sensor 1000 and a sound module 1002. The infrared sensor 1000 may be any suitable device that detects objects (e.g., obstacle 1004) within the path of the vacuum cleaner during operation. The infrared sensor 1000 is connected to the microcomputer 906 to provide information on detected objects. The sound module 1002 (which may be one of the effectors 908 described above with reference to FIG. 9) may be any suitable device that assists the operator in a vacuum cleaner rescue mission when the vacuum cleaner becomes trapped under the floor during an operation. The sound module 1002 may be configured to emit a loud sound or buzzer to assist a person in locating the vacuum cleaner.

Thus, it should be observed that embodiments of the vacuum cleaner are semi-autonomous or autonomous, thereby enabling the vacuum cleaner to service and clean a surface covered by raised access flooring. The vacuum cleaner includes a powerful vacuum pump. The dimensions of the vacuum cleaner are limited by the height of the raised floor and the distance among the posts that support the raised floor. In case of Tec Crete® raised flooring, the height is about 38 centimeters (cm) and the distance between adjacent posts is about 55 cm. The vacuum cleaner should weigh no more than 25 kilograms (kg). The power of the pump allows the vacuum cleaner to suck in dust and small debris, such as stones. The vacuum cleaner is configured to clean a path about 55 cm wide during one pass.

In one embodiment, the vacuum cleaner is equipped with a communications module that allows the vacuum cleaner to receive commands from a remote control station.

In one embodiment, a casing of the vacuum cleaner is round in shape, and a handle is provided to lower and lift the vacuum cleaner from under the floor. The shape of the vacuum cleaner enables the vacuum cleaner to turn around in place. The handle may have a capacity to lift an object that is about 30 kg.

In one embodiment, the vacuum cleaner has at least one video camera and a source of light installed on the vacuum cleaner. The communication module allows sending video to the remote control station.

In one embodiment, the vacuum cleaner has a sound module or buzzer installed on the vacuum cleaner, thereby making it easier to locate the vacuum cleaner in case of the vacuum cleaner becomes disabled or jammed in place. In such an instance, a remote control can send a command to the vacuum cleaner to initiate an audible alarm, and an operator can locate the source of the sound to locate the vacuum cleaner. To make locating easier, lights on the vacuum cleaner can be enabled.

In one embodiment, the vacuum cleaner has a chassis with wheels, for example four wheels. In a certain embodiment, the vacuum cleaner has two motors that are configured to drive two wheels on each side with the use of a transmission belt or a chain. This construction enables the vacuum cleaner to operate over small obstacles like cables. In an alternative embodiment, the vacuum cleaner can use caterpillar treads. It is also possible to use a four-wheel drive system.

In one embodiment, the vacuum cleaner can operate at a speed from one cm/sec to one m/sec, with a nominal operating speed from ten cm/sec to 50 cm/sec. In general, the vacuum cleaner can ride faster during an inspection mode compared to a normal cleaning mode.

In one embodiment, the vacuum cleaner has a vacuum module consisting at least of a suction module, a pump, a dust container, and a filter. In a certain embodiment, the vacuum cleaner has brushes on both sides pushing the dust and debris toward the suction module. In a certain embodiment, the filter may be a HEPA filter.

In one embodiment, the pump of the vacuum cleaner has a range of power between 300 Watts (W) and 1500 W, with a preferred range between 500 W and 1000 W. The power of the pump enables the suction of dust, small stones and debris.

In one embodiment, the vacuum cleaner is remote controlled, and can operate semi-autonomously or autonomously. For example, the vacuum cleaner may be controlled with the use of a joystick or a keyboard by observing the area ahead of the vacuum cleaner on a computer screen or on a head mounted display. In an autonomous mode, the vacuum cleaner rides over the area alone (without human control). In semi-autonomous mode, the vacuum cleaner has certain areas of operation defined, and is configured to wait for a human operator to decide whether to finish the pre-defined path or operate over or around obstacles.

In one embodiment, the vacuum cleaner has the module for registering the route covered by the use of an odometer and/or triangulation with the use of a radio beacon system.

In one embodiment, the vacuum cleaner is equipped with a high-energy density source of power. In a certain embodiment, the source of power is a battery having a minimum capacity of 5000 milliamp hours (mAh).

In one embodiment, the vacuum cleaner is configured to service and clean a space under a raised access floor.

In one embodiment, the vacuum cleaner is controlled remotely by the console communicating with the vacuum cleaner. In a certain embodiment, the vacuum cleaner is controlled by a radio or by a specially shielded cable.

In one embodiment, a console is provided to enable an operator to view images 360 degrees around the vacuum cleaner.

In one embodiment, a communication between a console and the vacuum cleaner is achieved by a separate transmission-receiver station, which may be lowered under the raised access floor (to overcome radio signal attenuation loss caused by floor panels).

In one embodiment, use of remote controlled or semi-autonomous or fully autonomous vacuum cleaners with high suction power allow for fast cleaning of space under the floor even during office hours. The vacuum cleaner can additionally verify the status of other devices under the floor or the status of the raised access floor without the necessity of opening or removing panels of the raised flooring.

In one embodiment, the vacuum cleaner has the casing with the shape close to the shape of a circle with a diameter of about 540 mm, which allows the vacuum cleaner to turn round among the posts of the raised access floor. Similarly, the dimensions of the vacuum cleaner enable the vacuum cleaner to turn round among the posts of the raised flooring.

In one embodiment, the vacuum cleaner has an aluminum frame, which is configured to enable the placement of the batteries.

In one embodiment, wheels of the vacuum cleaner extend downwardly from a base of the vacuum cleaner. This construction enables the vacuum cleaner to overcome obstacles about three cm high. The height of the wheels and total height of the vacuum cleaner is limited by the height of the raised access flooring.

In one embodiment, the vacuum cleaner has side brushes, which move the dust and debris towards the suction element. Additionally, the vacuum cleaner may be equipped with a dustbin installed on runners and locked in place with magnets to allow the dustbin to be easily inserted into and pulled out of the vacuum cleaner.

In one embodiment, the vacuum cleaner has a HEPA filter installed at the output of the pump to limit the amount of microscopic particles. The vacuum cleaner shown may be additionally equipped with the specially shaped module for dispersing the exhausted air flow which prevents from raising dust.

In one embodiment, the vacuum cleaner is equipped with two wide-angle lens cameras (e.g., 170 degree lens) and lights. The cameras and the lights allow for observation of an operation area of the vacuum cleaner.

In one embodiment, images from the cameras can be transmitted to a console, which is used by an operator to remotely control the vacuum cleaner. During operation, both cameras can be switched to show or display front and rear images. Alternatively, only one camera can be used to show an image in front of the vacuum cleaner according to a preferred direction of movement.

In one embodiment, the vacuum cleaner is controlled by a universal controller, such as a controller that is used for televisions and game consoles. Communication with the vacuum cleaner may be achieved through the transmission station connected to the console by USB. The console may be a notebook with a gamepad connected to a USB. The operator can monitor the status of the vacuum cleaner on a monitor of notebook. The operator can switch on/off the maximum power of the pump suction, switch on/off the buzzer, and switch on emergency transmission power (in case of loss of communication with the vacuum cleaner). The nominal power of the transmitter is ten mega Watts (mW). In case of an emergency, power can be temporarily increased to 100 mW (20% of the operation time).

In one embodiment, a console records images from the cameras (the number of frames per second can be adjusted) to allow auditing work done by the vacuum cleaner, and saves the recorded images (or movie) on external storage to display (or play) on another computer.

In one embodiment, when the vacuum cleaner becomes trapped or disabled, it may be necessary to locate the vacuum cleaner. A buzzer can be switched on and the lights can start blinking to make it easier to find the location of the vacuum cleaner.

In one embodiment, a battery indicator on a laptop screen can be provided to display information about the status of a battery of the vacuum cleaner.

In one embodiment, communication with the vacuum cleaner is carried by two paths: (a) by commands sent to the vacuum cleaner with the use of the RFM12BP (ISM 868 MHz-RoHs compliant) module—in case of emergency the power of the transmission can be increased to 100 mW (normally the module operates using 10 mW); or (b) by video images transmitted analogue in 5.8 gigahertz (GHz) (transmitter and receiver CamSAT)—the video transmission is a one-way transmission. It may be possible to implement digital transmission in 2.4 GHz. The range of the communication is about 100 meters (m).

In one embodiment, accelerometers, step motors and gyros, as well as radio beacons, may be used to measure and record the route of the vacuum cleaner, which allows planning further work. This prevents from unnecessary duplicating the cleaning of areas already cleaned.

In one embodiment, an intelligent charger controls a process of charging battery modules after removing them from the vacuum cleaner. Lithium-Ion (Polymer) batteries may require special protection against overloading and over-discharging of the batteries. A time necessary for charging one set of batteries may be about one to two hours. To operate continuously, there should be at least two sets of batteries.

In one embodiment, in an autonomous mode, the vacuum cleaner may be operated without supervision of the operator.

In one embodiment, a process of servicing and cleaning of raised access flooring with the use of the vacuum cleaner is disclosed.

In one embodiment, a process for operating the vacuum cleaner begins with inserting charged batteries in the vacuum cleaner. Discharged batteries may be inserted in a battery charger.

In one embodiment, panels of the raised access flooring are lifted, and the vacuum cleaner is positioned under the floor (with the use of the handle). A transmission station may be positioned close to the vacuum cleaner under the floor to obtain an optimal range of radio communication. The transmission station may be connected to a power supply. A console (e.g. a laptop) may be connected to the power supply, to the transmission station, and to a gamepad.

In one embodiment, the pump, cameras and lights of the vacuum cleaner may be switched on and the vacuum cleaner begins operating. The vacuum cleaner may be moved until a video signal worsens or an obstacle under the raised floor makes it impossible for further operation. The vacuum cleaner may turn and come back an adjacent row. If a console of the vacuum cleaner obtains a signal from the vacuum cleaner that the batteries are running low, a pump may be switched off, and the vacuum cleaner may be directed either manually or automatically to come back to the transmission station.

In one embodiment, after a cleaning operation, or to perform routine maintenance, the vacuum cleaner is lifted up out of the raised flooring. When lifted out, batteries of the vacuum cleaner may be exchanged. In addition, dust may be removed from the dustbin.

In one embodiment, the cleaning of one square meter of raised access flooring takes about 10 seconds. It is estimated that one hour of cleaning requires removing less than one percent (1%) of panels of the raised flooring, and does not disturb normal office work.

In one embodiment, the vacuum cleaner may be used in an inspection mode. In a certain embodiment, inspection mode may be similar to the above-described cleaning mode, but the pump of the vacuum cleaner is switched off. A problem/fault found under the raised flooring can be located by hearing the buzzer while walking on the floor. An operator can located the vacuum cleaner as the buzzer of the vacuum cleaner becomes louder to indicate an area where the panels should be removed.

In one embodiment, the vacuum cleaner may be used in an audit mode, which allows connecting of a console (notebook) to a LAN and/or Internet. This allows remote operation after obtaining authorization (e.g., digital certificates).

In one embodiment, the vacuum cleaner for raised access floor is equipped with a communications module, allowing for sending commands to the vacuum cleaner. The vacuum cleaner includes a casing having a shape close to circular in horizontal cross section (e.g., having a diameter of 49-54 cm), and a handle for lifting the vacuum cleaner up from under the floor.

In one embodiment, the vacuum cleaner has at least one video camera and lights for lighting the area around the vacuum cleaner. In a certain embodiment, the vacuum cleaner also may have parking lights, with the above-mentioned communication module allowing transmission of images from the above-mentioned camera to the console.

In one embodiment, the vacuum cleaner additionally has a sound module to enable locating the vacuum cleaner in case of breakdown or getting stuck under the floor.

In one embodiment, the vacuum cleaner has a chassis module, equipped with wheels, and, in a certain embodiment, four wheels or caterpillar treads.

In one embodiment, the vacuum cleaner has a drive module, allowing for the vacuum cleaner to operate at a speed of one cm/sec to one m/sec, and, in a certain embodiment, ten cm/sec to 50 cm/sec.

In one embodiment, the vacuum cleaner has a vacuum module including at least a suction module, a pump, a dustbin, and a filter.

In one embodiment, the vacuum cleaner has side brushes for moving debris toward the above-mentioned suction module.

In one embodiment, the vacuum cleaner includes a HEPA filter.

In one embodiment, the pump of the vacuum cleaner has power of between 300 W and 1500 W, and, in a certain embodiment, between 500 W and 1000 W.

In one embodiment, the vacuum cleaner has a specially shaped module for dispersing the exhausted air flow from the above mentioned pump.

In one embodiment, the vacuum cleaner is remote controlled, either semi-autonomously or autonomously.

In one embodiment, the vacuum cleaner has a module for recording a route covered during operation of the vacuum module with an odometer and/or triangulation and radio beacons.

In one embodiment, the vacuum cleaner is equipped with high density of energy source of power, such as lithium-ion polymer or lithium batteries, with a total capacity of minimum 5000 mAh.

In one embodiment, the vacuum cleaner weighs no more than 25 kg.

In one embodiment, the vacuum cleaner may be used to service or clean a space under a raised floor.

In one embodiment, the method includes controlling the vacuum cleaner remotely, with the use of a console communicating with the vacuum cleaner, and, in a certain embodiment, by radio or by shielded cable.

In one embodiment, the method includes showing images of an area in front of or behind the vacuum cleaner on a console, and, in a certain embodiment, 360 degree around the vacuum cleaner.

In one embodiment, the method further includes communicating between the console and the vacuum cleaner by means of a transmitter-receiver station, which is lowered under the floor, or by an antenna, which is lowered under the floor.

Having thus described several aspects of at least one embodiment of this disclosure, it is to be appreciated various alterations, modifications, and improvements will readily occur to those skilled in the art. Such alterations, modifications, and improvements are intended to be part of this disclosure, and are intended to be within the spirit and scope of the disclosure. Accordingly, the foregoing description and drawings are by way of example only.

What is claimed is:

1. A vacuum cleaner for raised floor environments, comprising:

a body;

a power source supported by the body;

a vacuum module supported by the body, the vacuum module being configured to intake air and exhaust air; and a drive module supported by the body, wherein the body includes an outer casing having an upper dissipation plate that blocks exhaust air from the vacuum module and directs the exhaust air to channels formed in an outer surface of the casing, the channels being configured to divide and channel exhaust air and to direct exhaust air in multiple directions.

2. The vacuum cleaner of claim 1, further comprising a controller supported by the body, the controller being configured to control the operation of the power source, vacuum module and drive module.

3. The vacuum cleaner of claim 2, further comprising an infrared sensor supported by the body, the infrared sensor being coupled to the processor and configured to detect objects proximate to the body of the vacuum cleaner.

4. The vacuum cleaner of claim 3, wherein the controller is configured to send and receive signals from the infrared sensor to detect objects.

5. The vacuum cleaner of claim 2, further comprising a communications module supported by the body.

6. The vacuum cleaner of claim 5, wherein the communications module comprises a receiver supported by the body and a transmitter supported by the body.

7. The vacuum cleaner of claim 1, wherein the drive module includes two wheels on a left side of the vacuum cleaner, two wheels on a right side of the vacuum cleaner, and independent drive systems for the left side and the right side configured to allow the vacuum to turn in place.

8. The vacuum cleaner of claim 1, wherein the vacuum module includes a suction module, a dustbin, a pump, and a filter, supported by the body.

9. The vacuum cleaner of claim 1, further comprising a sound module.

10. The vacuum cleaner of claim 1, wherein the power source is a battery selected from the group consisting of a lithium-ion polymer battery and a lithium-ferrum battery.

11. The vacuum cleaner of claim 1, further comprising an electronic amplifier in electrical communication with the power source, wherein the electronic amplifier is capable of converting a voltage from about 22 to 24 volts to a voltage of greater than 200 volts.

12. The vacuum cleaner of claim 1, further comprising at least one video camera supported by the body.

13. The vacuum cleaner of claim 1, further comprising a light supported by the body.

14. The vacuum cleaner of claim 1, further comprising a video recording device supported by the body.

15. A method of channeling exhaust air from a vacuum cleaner for raised floor environments comprising a plurality of raised panels disposed above a floor, the method comprising:

providing a vacuum cleaner for raised floor environments comprising a body, a power source supported by the body, a vacuum module supported by the body, the vacuum module being configured to intake air and exhaust air, a drive module supported by the body, the body including an outer casing, the outer casing having an upper dissipation plate that blocks exhaust air from the vacuum module and directs the exhaust air to channels formed in an outer surface of the casing, the channel being configured to divide and channel exhaust flow and to direct exhaust flow in multiple directions; and performing a cleaning operation with the vacuum cleaner.

* * * * *